US006263816B1

(12) United States Patent
Codos et al.

(10) Patent No.: US 6,263,816 B1
(45) Date of Patent: Jul. 24, 2001

(54) MATTRESS COVER PRINTING AND QUILTING SYSTEM AND METHOD

(75) Inventors: Richard N. Codos, Warren, NJ (US); M. Burl White, Jacksonville Beach, FL (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/649,471

(22) Filed: Aug. 28, 2000

Related U.S. Application Data

(63) Continuation-in-part of application No. 09/480,094, filed on Jan. 10, 2000, now Pat. No. 6,158,366, which is a continuation-in-part of application No. 09/250,352, filed on Feb. 16, 1999, now Pat. No. 6,012,403, which is a continuation-in-part of application No. 09/070,948, filed on May 1, 1998, now Pat. No. 5,873,315.

(51) Int. Cl.[7] ..... D05B 11/00; D05B 21/00; B41M 3/00

(52) U.S. Cl. ..... 112/475.08; 112/117; 112/130; 112/470.05; 101/35

(58) Field of Search ..... 112/117, 118, 112/119, 470.05, 475.01, 475.08, 470.01, 130, 304, 307; 101/35

(56) References Cited

U.S. PATENT DOCUMENTS

| | | | |
|---|---|---|---|
| 3,611,961 | | 10/1971 | Lopez et al. . |
| 3,960,095 | | 6/1976 | Story . |
| 4,675,253 | * | 6/1987 | Bowditch . |
| 4,748,920 | | 6/1988 | Stutznacker . |
| 4,785,750 | | 11/1988 | Best . |
| 4,860,675 | | 8/1989 | Brower et al. . |
| 4,953,485 | | 9/1990 | Brower et al. . |
| 5,018,416 | | 5/1991 | Freemann . |
| 5,022,323 | | 6/1991 | Schultheis . |
| 5,040,473 | | 8/1991 | Zesch et al. . |
| 5,095,835 | | 3/1992 | Jernigan et al. . |
| 5,099,773 | | 3/1992 | Codos . |
| 5,144,899 | | 9/1992 | Allen . |
| 5,154,130 | | 10/1992 | Gribetz et al. . |
| 5,159,874 | | 11/1992 | Adamski, Jr. et al. . |
| 5,289,788 | | 3/1994 | Fukumoto . |
| 5,461,999 | | 10/1995 | Marcangelo . |
| 5,544,599 | | 8/1996 | Frazer et al. . |
| 5,685,250 | | 11/1997 | Kaetterhenry et al. . |
| 5,873,315 | | 2/1999 | Codos . |
| 6,012,403 | | 1/2000 | Codos et al. . |

* cited by examiner

*Primary Examiner*—Peter Nerbun
(74) *Attorney, Agent, or Firm*—Wood, Herron & Evans, L.L.P.

(57) ABSTRACT

Ticking for the production of mattress covers is preprinted with a plurality of different patterns by a computer controlled printer that prints in response to pattern data communicated from a control computer. The pattern data is organized and communicated by the computer so that a print head, for example, can scan the ticking material, such as in rows across the width of a web, and print different patterns. For example, different border panels can be oriented along a web and positioned side-by-side across a web and each printed with a different pattern. Top and bottom panels having corresponding patterns can be printed on the same or a different web. Identifying data for matching the panels of a mattress product can be provided in data files in the same or a different computer or can be printed on the fabric along with the patterns on the panels. The printed data can be manually or machine readable so that cutting and slitting of the panels from each other and the quilting and combining of the panels for assembly of a mattress product can be carried out manually or automatically.

30 Claims, 3 Drawing Sheets

MATTRESS COVER PRINTING AND QUILTING SYSTEM AND METHOD

This is a Continuation-In-Part and commonly assigned U.S. patent application Ser. No. 09/480,094, filed Jan. 10, 2000, now U.S. Pat. No. 6,158,366 which is a Continuation-In-Part of U.S. patent application Ser. No. 09/250,352, filed Feb. 16, 1999, now U.S. Pat. No. 6,012,403, which is a Continuation-In-Part and commonly assigned U.S. patent application Ser. No. 09/070,948, filed May 1, 1998, now U.S. Pat. No. 5,873,315, all of which are hereby expressly incorporated by reference herein.

FIELD OF THE INVENTION

The present invention relates to quilting, and particularly to the quilting of pattern bearing products such as mattress covers. The invention particularly relates to the manufacture of quilted materials which bear printed patterns.

BACKGROUND OF THE INVENTION

Quilting is a special art in the general field of sewing in which patterns are stitched through a plurality of layers of material over a two-dimensional area of the material. The multiple layers of material normally include at least three layers, one a woven primary or facing sheet that will have a decorative finished quality, one a usually woven backing sheet that may or may not be of a finished quality, and one or more internal layers of thick filler material, usually of randomly oriented fibers. The stitched patterns maintain the physical relationship of the layers of material to each other as well as provide ornamental qualities.

Large scale quilting operations have been used for many years in the production of bedding products. Mattress covers, which enclose and add padding to inner spring, foam or other resilient core structure, provide functional as well as ornamental features to a mattress. Mattress covers are typically made up of quilted top and bottom panels, which contribute to the support and comfort characteristics of a mattress, and an elongated side panel, which surrounds the periphery of the mattress to join the top and bottom panels around their edges to enclose the inner spring unit or other mattress interior.

Mattresses are made in a small variety of standard sizes and a much larger variety of combinations of interiors and covers to provide a wide range of support and comfort features and to cover a wide range of product prices. To provide variety of support and comfort requirements, the top and bottom panels of mattress covers are quilted using an assortment of fills and a selection of quilted patterns. To accommodate different mattress thicknesses, border panels of different widths are required with variations in the fill for border panels being less common. Border panels as well as top and bottom panels are usually made in different sizes to accommodate all of the standard mattress sizes.

Mattress covers are usually quilted on web-fed multi-needle quilters. Only one side of the quilted product need be finished for a mattress cover, so one layer of ornamental top goods or ticking is usually combined on a chain stitch quilting machine with fill and backing material to produce the mattress cover products. The ornamental characteristics of the ticking that form the outer surface of a mattress is regarded as important in the marketing of bedding products. Bedding manufacturers stock a variety of ticking materials of different colors and types, many having different sewn or printed patterns. Maintaining an adequate inventory of ticking requires the stocking of rolls of different widths of materials of different colors and patterns. The cost of such an inventory as well as the storage and handling of such an inventory contributes substantially to the manufacturing cost of bedding products.

Multiple needle quilters of the type illustrated in U.S. Pat. No. 5,154,130, hereby expressly incorporated by reference herein, are customarily used for the stitching of mattress covers. Such quilters include banks of mechanically ganged needles that sew multiple copies of a recurring pattern. Some of these quilted patterns are highly ornate and contribute materially to the appearance of the quilted products, particularly those that are of higher quality and cost, and which are made in smaller quantities. Other quilted patterns, such as simple zig-zag patterns, are more functional, and rely on the varieties of the ticking material for the visual distinctiveness of the product. The varieties of ticking materials include those sewn or printed with different patterns. Printed patterns are usually applied by the ticking supplier and rolls of ticking of each pattern are inventoried by the mattress cover manufacturer.

The ticking materials commonly bear a pre-applied pattern when rolls thereof are loaded onto the quilting machines. Lower cost mattresses are often made by sewing generic quilted patterns onto printed pattern material. However, frequent changing of the ticking material to produce products having a variety of appearances, requires interruption of the operation of the quilting machine for manual replacement and splicing of the material. This adds to labor costs and lowers equipment productivity. Further, the spliced area of the material web which must be cut from the quilted material is wasted. Furthermore, since mattress top and bottom panels are often thicker, and vary in thickness more than border panels, border panels are sometimes quilted on quilting lines that are separate from those used to quilt the top and bottom panels. Since border panels are usually preferred to match the top and bottom panels, the changing of ticking on the top and bottom panel line is almost always accompanied by a similar change of ticking material on the border panel line. Coordination of the two production lines, as well as the matching of border panels with the top and bottom panels, requires well executed control procedures and can lead to assembly errors or production delays.

There is a need in mattress cover manufacturing to improve the productivity and efficiency of making quilted products, particularly mattress covers, having a variety of designs without increasing, or while reducing, production costs.

SUMMARY OF THE INVENTION

An objective of the present invention is to provide an efficient and economical system and method for providing fabric panels of a variety of printed patterns, particularly differently patterned panels in small quantities. It is a particular objective of the present invention to provide flexibility in the production of mattress ticking and quilted mattress covers having patterns that can differ from product to product.

A particular objective of the present invention is to provide for the efficient arrangement of top, bottom and border panels of different printed patterns on one or more webs or sections of a fabric. A further objective of the invention is to coordinate the matching and assembly of the different panels that make up each of a plurality of differently patterned mattress covers or other fabric products.

According to the principles of the present invention, webs of ticking or units of other fabric are printed with patterns under the control of a computer controlled printer. Such printers are typically digital printers and may be referred to as digital printers, and include ink jet printers, continuous and dot-on-demand printers, and other printers that print images by dispensing ink or other printing medium in response to pattern information, which can usually vary from copy to copy, rather than from a physical mat, plate or mechanical transfer surface such as those commonly used for printing multiple copies of the same image.

In the preferred application of the invention, an ink jet printer scans a web of ticking material transversely and prints on the web in response to signals from a programmed computer. In one preferred embodiment of the invention, each scan row need not necessarily print only on the same panel, but can print one or more lines of each of several panels that are arranged transversely across the web of material. Each panel can be printed with the same pattern, each with a different pattern or some with the same pattern and others with one or more different patterns. Top and bottom panels that match or correspond to each of the border panels can be printed on different parts of the same or a different web.

After printing, the webs of ticking are usually quilted to one or more layers of fill material and usually a layer of backing material. The quilting may be applied to quilt different patterns on different panels or different sections of web containing more than one panel, or an entire web or length of web may be quilted with a generic pattern.

After the printing and after the quilting, where applicable, different panels are separated from adjacent panels of the web by longitudinal slitting or transverse cutting. The cut panels are subsequently matched with other corresponding panels to form a mattress cover, which is matched with a spring interior unit and one or more layers of padding for assembly into a bedding product.

Each panel is preferably identified with a particular bedding product and may be identified with a particular item of a particular customer order. The identification and/or information relating to the properties of the panel can be contained in a computer file that is synchronized to each panel on the fabric. Such information can also be printed or coded on the fabric, on or adjacent a panel, preferably in the same printing operation that applies the printed panels to the material, which coding can be in the form of either manually readable information, machine readable information or a combination of manually readable and machine readable information. Such information can be manually read for control of the quilting, the cutting and slitting and the machine of panels and assembly into bedding products. Preferably, the information is automatically read and signals are then generated in response to the information to control the quilting of the printed material, the cutting and slitting of the panels from the web, and the matching of corresponding panels for assembly into bedding products.

Product labels such as those identifying the manufacturer, a retailer or a bedding product type or model, as well as describing the product, can be printed on the fabric in the same operation as the printing of a panel with a pattern.

The present invention provides great flexibility in producing products of a wide variety of appearances and greatly reduces the ticking inventories of a mattress manufacturer.

These and other objects of the present invention will be more readily apparent from the following detailed description of the drawings.

DETAILED DESCRIPTION OF THE PREFERRED EMBODIMENT

Figure 1:
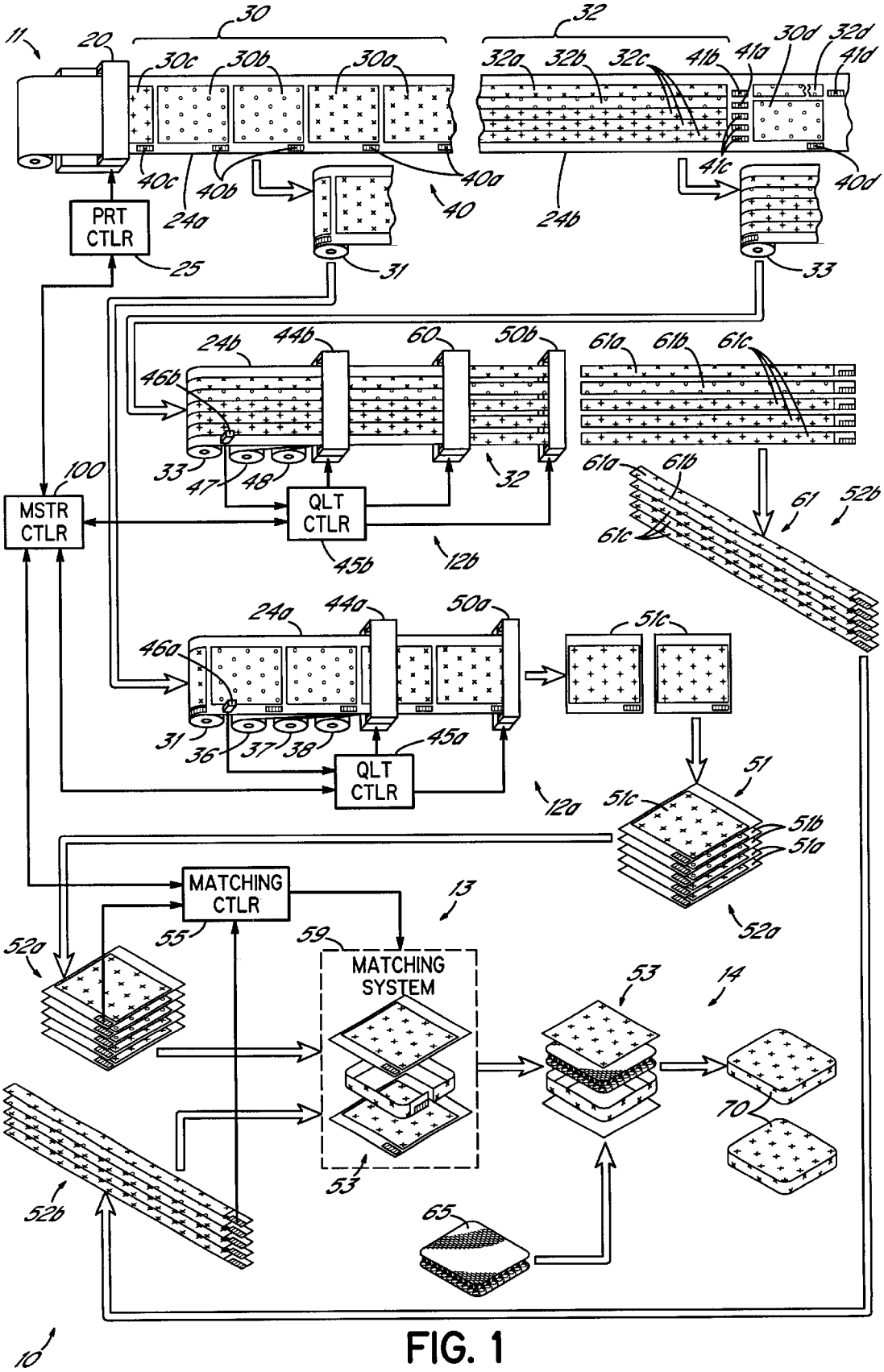
FIG. 1 is a diagram of one embodiment of a mattress cover quilting system embodying principles of the present invention.

FIG. 1 illustrates a mattress cover manufacturing system 10 according to one embodiment of the present invention. The system 10 can be divided into four subsystems or production lines, including at least one print line 11, at least one, and preferably two or more, quilting lines 12, illustrated as two quilting lines 12*a* and 12*b*, a mattress cover combining a line 13 and a mattress assembly line 14. These production lines 11–14 may be located at a single bedding manufacturing facility or distributed among different facilities of the same or different companies.

Figure 2:
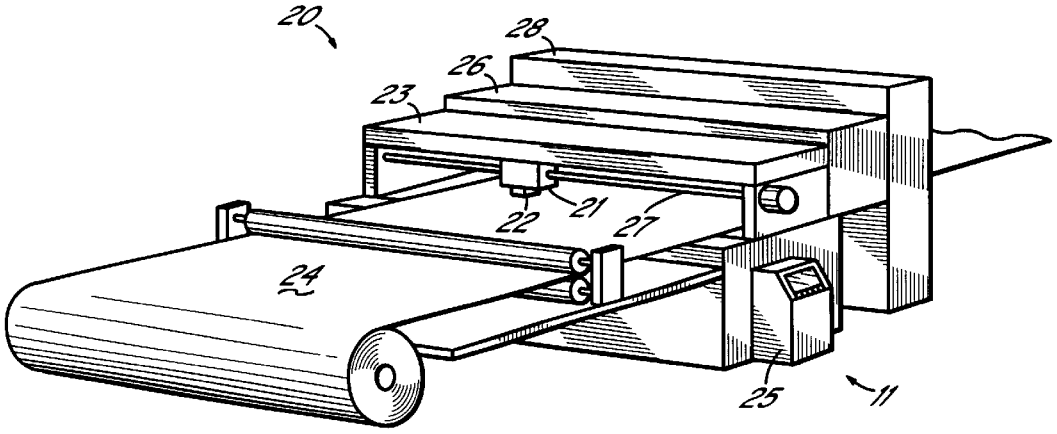
FIG. 2 is a perspective view of a pattern printing portion of the system of FIG. 1.

The printing line 11 includes an ink jet printing station 20 illustrated in more detail in FIG. 2. The printing station 20 is operable to print an image from a memory, or otherwise in accordance with a programmed controller, onto mattress cover material. By so printing, the image can be controlled and varied from product to product along the material or from one portion of the material to another. Such printing may be referred to as digital or custom printing, although the control signals need not necessarily be, but preferably will be, digital signals, that determine the patterns and images to be printed.

At the printing station 20, a print head carriage 21 is preferably provided having one or more print heads 22 thereon. The carriage 21 is moveable transversely on a bridge 23, which is rigidly mounted to a frame 26 and spans the width of the printing line 11, which is wide enough to accommodate a print head path that traverses the width of the widest expected web 24 of mattress ticking, which may be nominally wider than the width of the king size mattress, which is 80 inches. The carriage 21 is preferably driven by a linear motor 27, which, along with the operation of the print heads 22, are controlled by a print line controller 25 to selectively print a dot pattern image on the web 24. The print heads, in the illustrated embodiment, scan individual lines across the entire transverse extent of the web 24 to print line-by-line along the length of the web 24, although the print heads 22 may be controlled to scan in different x-y paths to also print patterns in area-by-area or otherwise.

The printing station may include a UV curing station 26, at which UV curable ink is cured with ultraviolet light and/or a drying oven 28, which can further cure or dry UV inks or solvent based inks. A suitable printing station and method are described in the commonly assigned and copending U.S. patent application Ser. No. 09/390,571, filed Sep. 3, 1999, hereby expressly incorporated by reference herein.

The print line controller 25 includes a digital memory in which may be stored a plurality of pattern data files. Pattern and other data from these files, and/or from a master system controller or computer 100, can be printed at selected locations on the web 24. The master controller 100, in certain preferred embodiments, sends commands to the print line controller 25 to coordinate the printing of different mattress cover patterns onto the web 24 that are grouped together in batches that will be quilted in the most efficient sequence on the same quilting line 12, with a minimum of needle changes, material changes or other adjustments or operator interventions. Typically, this would mean that the top and bottom panels of a mattress cover would be grouped separate from the border panels, because the top and bottom panels are usually thicker, having more fill, than the border panels. Furthermore, top and bottom panels vary more in thickness from one mattress product to another while border panels often are of the same thicknesses for many different mattress products.

In FIG. 1, for example, patterns for a series of king size top and bottom panels 30 are shown printed along a length 24*a* of the web 24. These include: two panels 30*a*, a top panel and a bottom panel of a first printed pattern; two panels 30*b*, a top panel and a bottom panel of a second printed pattern to be printed; and a panel 30*c* of the next pattern to be printed. These patterns are shown as changing from one product to another for illustration purposes. More typically, several products of each pattern will be printed in succession according to an order schedule. These patterns 30 are printed under the batch control of the master controller 100 according to a schedule that assigns orders for products bearing the patterns of panels 30*a–c* to a particular print line 11, or to a particular series to be printed on the web section 24*a*. The grouping of the products to be made of the panels 30*a–c* to the same section of web 24*a* is assigned by the master controller 100 making the determination that these panels are to be quilted with similar quilted patterns and with the same fill components, so that they can be run on the same quilt line 12 without interruption to make machine adjustments or material or needle changes, for example. When all panels 30 that are to be quilted consecutively on the same quilting line 12 are printed on the web section 24*a*, the web section 24*a* is preferably cut and separately wound in a roll 31 for transfer to a quilting line 12*a* for quilting.

The controller 100 then batches border panels 32 for printing. These border panels 32 may be printed on the same or a different print line 11 on which the top and bottom panels 30 were printed. The border panels are long narrow strips typically 10 to 20 inches wide, but which may be wider or narrower, and usually in the range of from 18 to 27 feet long in order to surround the perimeter of a mattress, although they may be formed in shorter strips and later sewn together. The border panels 32 will be printed to match the top and bottom panels 30 that are printed onto the web section 24*a* and rolled in the roll 31. The border panels 32 may include, for example, a border panel 32*a*, which is printed of the same pattern as, or one matching, the pattern of the panel 30*a*. Similarly, patterns 32*b* may be printed with patterns corresponding to the pattern printed for the panels 30*b*, and patterns 32*c* may be printed with patterns corresponding to the pattern printed for panels 30*c*. The corresponding patterns can be printed in the same or a different orientation or size. These border panels 32 are printed on a web section 24*b* to be rolled into a roll 33 for transfer to the quilting line 12*b*, which is set up for the quilting of border panels.

Figure 3:
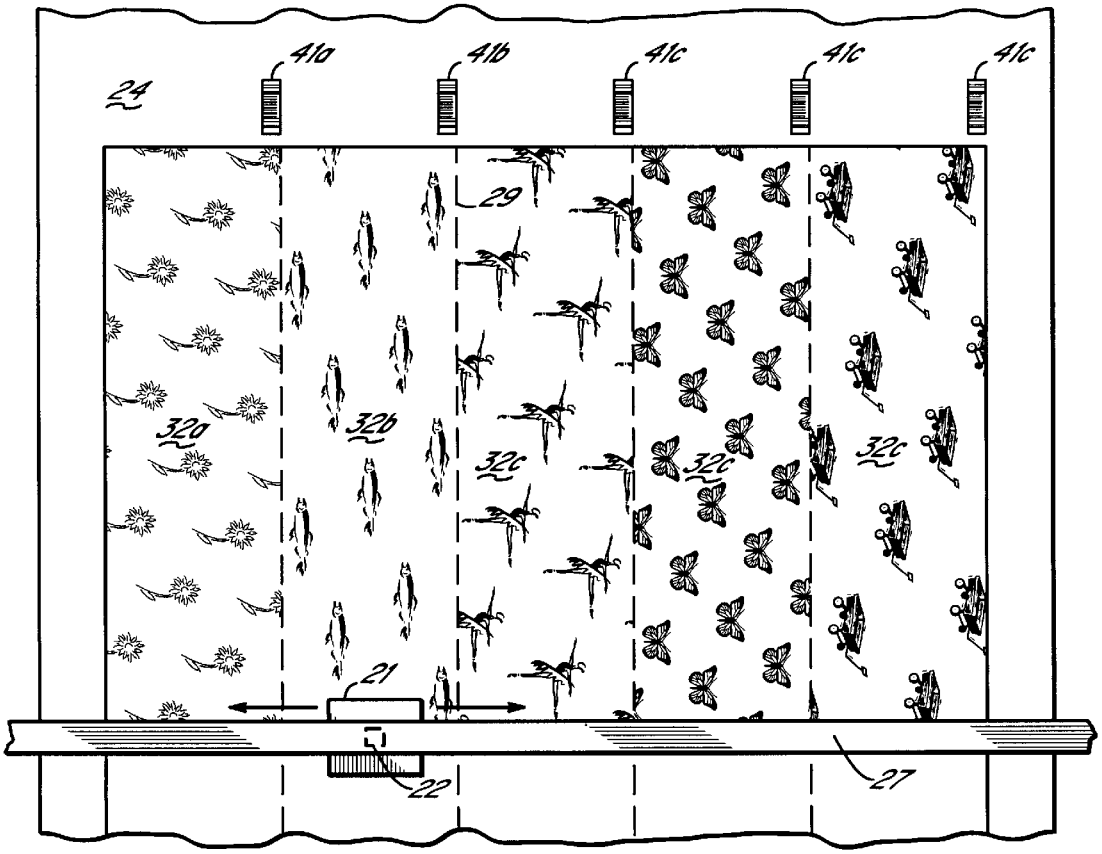
FIG. 3 is a fragmentary plan view of a web of ticking being printed at the print line of the system of FIG. 1 showing the transverse arrangement of a set of border panels bearing different patterns.

In the quilting of border panels 32, the long narrow panels 32 are arranged to most efficiently use the area of the web section 24*b*. For example, five 16 inch border panel strips can be printed across the width of an 80 inch web section 24*b*, as illustrated in FIG. 3. For this arrangement, the print head 22 is controlled by the print line controller 25 to scan the entire transverse width of the web, line-by-line, to print one row of dots of the different patterns of each of the five panels across the width of the web section 24*b*, then to print another row of dots, and so forth, until each consecutive row of dots is printed similarly as the web section 24 advances in one direction through the printing station 20. Alternatively, the print heads 22 can be moveable in a plane relative to the material and can be controlled to print selected areas of different patterns in various orders, as may be convenient. The patterns on the border panels across the width of the web 24*b* may be the same or each may be different, as illustrated. Cut lines 29 may also be printed to indicate where the panels 32 are to be slit or transversely cut from one another.

The arrangement of the patterns are printed on the web groups of the panels such that those having similar quilting parameters are grouped together. Panels having the same quilted patterns and that call for the same needle settings can be arranged contiguously on the material. Border panels, for example, of different products usually, but not necessarily, have the same fill characteristics. Panels of similar characteristics can be grouped together, and particularly if they have the same quilt patterns, can be arranged side-by-side. Where possible, the arrangements of the printed patterns on the material is carried out to minimize material waste and production inefficiency. Pattern arrangements can be made automatically by a batch mode controller or scheduling computer that is programmed to implement some arranging criteria.

In addition to border panels 32, top and bottom panels 35 can also be arranged on the web section 24*b*, which may be desirable where such top and bottom panels are to be quilted to the same thickness as that of the border panels 32. In such a case, a top or bottom panel 30*c*, for example, of a full rather than king size mattress, may be printed with the matching border panel 32*c* for the same mattress fit in along side of the top and bottom panels 35.

Figure 4:
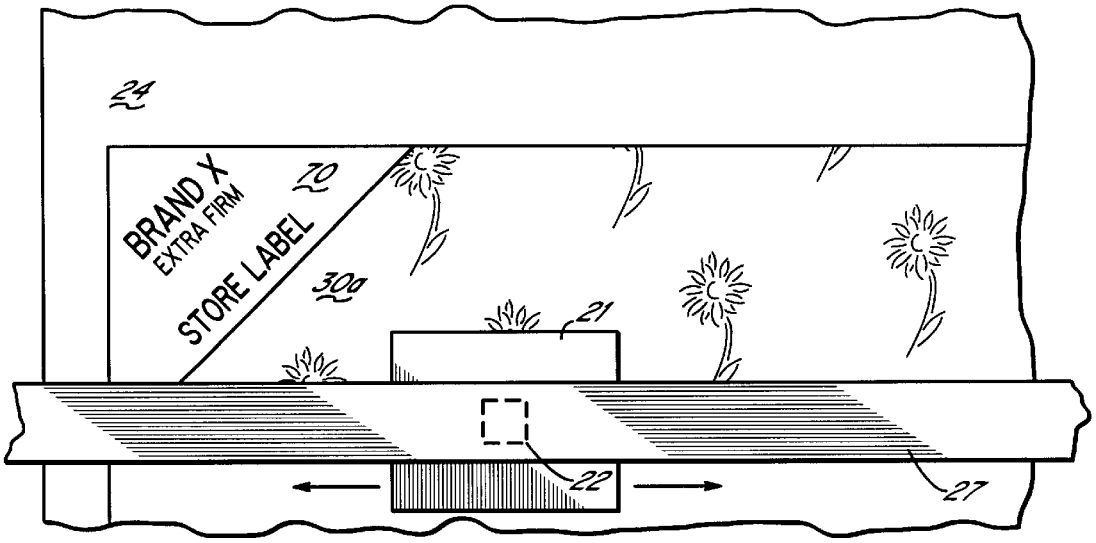
FIG. 4 is a fragmentary plan view of a web of ticking being printed at the print line of the system of FIG. 1 showing the printing of a bedding manufacturer's label along with the printing of a pattern on a top panel of a mattress cover.

Further, manufacturer or retailer labels, such as a retailer label 70, can be printed directly on the bedding products by the print heads 21 at the printing station 20, as illustrated in FIG. 4. Heretofore, labels have been sewn onto bedding products. The retailer's label 70 can, instead, be printed along with the pattern on the print line 11 at, for example, the corner or edge of top panel 30*a*, as the carriage 22 scans the print head 21 across the web 24 to print the pattern for the panel 30*a* of a mattress identified to a specific order. Where a bedding manufacturer makes bedding for a number of retailers, labels can be customized to designate different store brands or product models. Even individual retail customer names can be applied for custom mattress orders. This can be done on a batch or piece-by-piece basis, as products for various retailers are batched for quilting. Such labels can be printed on a panel along with the pattern at the printing station 20. The labels can include machine readable information such as bar code encoded information identifying or describing the product, customer or order.

With the batch mode scheduling provided by the controller 100, provision is made for the communication of information to the quilting lines 12, the combining line 13 and the assembly line 14 so that the top and bottom panels are correctly matched with border panels 32 and the resulting mattress cover is matched with the correct inner spring unit. This may be carried out by generating information records, which can be done in any of several ways. One method of coordinating information, and one of the more reliable, is by attaching information records to the mattress cover panels. This can be achieved by printing product codes at the printing station 20 along with the printing of the patterns 30, 32. Such printed records can be in the form of bar codes or other machine readable records.

Bar code labels are illustrated as areas 40 and 41 in the drawings. The codes 40 are, for example, shown in FIG. 1 as codes 40*a–d,* which contain information identifying the products for which top and bottom panels 30*a–d* belong, with bar codes 41*a–d* identifying the products to which border panels 32*a–d* belong. These codes are then read by sensors at subsequent stations so that subsequent operations can be automatically carried out that are appropriate for the particular products. In addition, or in the alternative, to the printing of machine readable indicia or codes, the printer can also print manually readable information that can be used by a quilting machine operator, by those manually matching components in a mattress cover or mattress assembly, or by others in subsequent operations.

Rather than employ codes 40, 41 printed on the material to identify the patterns, electronic files containing identifying information can be synchronized among the controllers of the various lines through the master computer 100. For example, the printing of patterns at the print line 11 can cause information as to where and what was printed to be passed by the print line controller 25 to the master controller 100. The master controller 100 then transmits the printed pattern information along with information tracking the location of the printed patterns through the system 10 to the various controllers of the lines 12, 13, 14 controlling and keeping track of each product component in the flow through the system 10.

For the quilting part of the operation, the roll 31 bearing the top and bottom printed panels 30 on the web 24*a* of ticking is loaded onto the quilting line 12*a*, where the web 24*a* is combined with, for example, two layers of fill 36, 37 and one web of backing material 38. The layers are advanced through a quilting station 44*a* at which the layers are quilted together with, for example, a generic quilted pattern, such as a plurality of side-by-side continuous zig-zag patterns. Typical patterns, as well as a multi-needle quilting machine suitable for use as the quilting station 44*a*, are illustrated and described in U.S. Pat. No. 5,154,130, hereby expressly incorporated by reference herein. The quilting station 44*a* is controlled by a controller 45*a* which controls the quilting of the patterns under the control of the master controller 100 which selects the proper pattern for the product to which the patterns of the panels 30 relate. Coordination between the printed and quilted patterns may be accomplished, for example, by a sensor 46*a* which reads the printed codes 40, or by signals from the controller 100, communicated to the quilting station controller 45*a*.

The quilting line 12*a* also includes a panel cutting station 50, which may also be operated by the quilting station controller 45*a* or a cutter on the panel cutter in response to coordinating signals from a master controller, the quilting station controller or from codes read from the product such as by independently reading a bar code on the product. The cutter at the cutting station 50*a* uses coordination information from the controller 45*a* to determine where to sever the individual panels 30. Different panels may be cut to different lengths in accordance with product size information from batch control product parameter data through the controller 100. The cutting of the panels may be controlled to accommodate for "shrinkage" that occurs as the material dimensions change in the quilting process. The cutting produces completed individual rectangular top and bottom mattress cover panels 51, which include, for example, one pair of top and bottom panels 51*a* bearing the printed patterns 30*a*, one pair of panels 51*b* bearing the printed patterns 30*b* and a series of panels 51*c* bearing the printed patterns 30*c*. Panel cutters are illustrated and described in U.S. Pat. No. 5,544,599 and in U.S. patent application Ser. No. 09/359,535, filed Jul. 22, 1999, both hereby expressly incorporated herein by reference. These cut panels are then placed in a stack 52 and transferred to an area, referred to as a matching subsystem 59 of the combining line 13, at which the corresponding top and bottom panels are matched with corresponding border panels to make up the mattress cover sets 53 for each of the products. The matching may be coordinated manually or with the batch mode control by the system controller 100, directly, or through a separate matching controller or computer 55.

Similarly, the roll 33 bearing the printed border panels 32 on the web 24*b* of ticking is loaded onto the quilting line 12*a*, where the web 24*b* is combined with, for example, one layer of fill 47 and one web of backing material 48. The layers are advanced through a quilting station 44*b* at which the layers are quilted together with, for example, the same generic quilted pattern or patterns as applied at the quilting station 44*a* of the line 12*a*. The quilting station 44*b* is also controlled by a controller 45*b* which also controls the printing of the patterns under the control of the master controller 100 which selects the proper pattern for the product to which the patterns of the panels 32 relate. Coordination between the printed and quilted patterns at the quilting line 12 may be accomplished, for example, by a sensor 46*b* which reads the printed codes 40, or by signals from the controller 100, communicated to the quilting station controller 45*b*.

The quilting line 12*b* also includes a panel cutting station 50*b*, which is also operated by the quilting station controller 45*b*, and is similar to the cutting station 50*a* of the quilting line 12*a*. The cutting station 50*a* can be controlled by the quilting line controller, through a master controller or independently by reading codes, such as bar codes, printed on the panels with the pattern. The cutter at the cutting station 50*b* uses coordination information from the controller 45*b* to determine where to transversely sever one set of transversely adjacent border panels 32 from another set. This transverse cutting may take place before or after the individual border panels are slit to separate one border panel from another. The cutting and slitting processes produce completed individual rectangular border panel strips. The top and bottom mattress cover panels 51, which include, for example, one pair of top and bottom panels 51*a* bearing the printed patterns 30*a*, panels 51*b* bearing the printed patterns 30*b*, and panels 51*c* bearing the printed patterns 30*c*, are similarly cut from the material. These cut panels are then placed in a stack 52*b* and transferred to the matching subsystem 13 for matching with corresponding top and bottom panels as described above.

Provision for the slitting of transversely arranged panels is made by equipping one or all of the quilting lines 12 with a slitting station 60 for longitudinally separating panels 30, 32 or other panels one from another, or to trim the selvage or other material from the edges. Such a slitting station is illustrated in the quilting line 12*b*, where it is shown located between the quilting station 44*b* and the cutting station 50*b*. The slitting station 60 has a plurality of transversely adjustable and selectively operable slitting or trimming elements or knife assemblies (not shown), which can be positioned and operated to selectively slit the web 24*b*. In the embodiment shown, the knives can be operated to longitudinally slit the web 24 in four places to separate the five border panels 32 from each other. The completed border panels 61, so separated by slitting and transverse cutting, are then set in stack 52*b* for transfer to the matching station 13. The separate individual rectangular border panel strips 61 include, for example, border panel 61 a bearing the printed patterns matching top and bottom panels 51*a*, border panel 61b bearing the printed patterns matching top and bottom panel 51*b*, and border panels 61*c* bearing the printed patterns matching top and bottom panels 51*c*. These cut panels are then placed in a stack 52*b* and transferred to the matching subsystem 59 for matching with corresponding top and bottom panels as described above.

Trimming knife assemblies may be made selectively operable and transversely moveable by motors or actuators under control of the quilting line controller 45*b*. Registration of the cutting and slitting station elements with the printed patterns is carried out at the quilting lines 12 or can be carried out on independent cutting lines on which the printed and quilted material is placed for cutting and trimming. Techniques described in the parent applications for achieving registration between printing and quilting may be used for registration between cutting and/or slitting and printing. Information for activating and/or positioning the trimming knives, as well as the transverse cutting knives, may be communicated via electronic files from the master controller 100 to the quilting and cutting line controllers 45*a*, 45*b*, or may be contained in coded information and/or separation lines 29 printed on the ticking with the patterns at the print line 11. The registration techniques and web alignment techniques of the parent applications identified above for registering the quilted and printed patterns may also be used for registering and aligning the cutting and slitting operations with the patterns printed on the web of ticking material. In locating the cuts and slits automatically, direct sensing of printed cut lines or calculated shrinkage compensation along with precise tracking of the material through the system should be employed.

After matching of the completed border panels 61 with the top and bottom panels 51 at the matching subsystem 59 of the combining line 13, the components of a mattress cover set 53 are assembled onto an inner spring unit 65 in a conventional manner on the mattress assembly line 14 to form the finished mattress products 70. The matching of the mattress cover sets 53 with the proper inner spring units 65 are also carried out under the control of the master controller 100. For proper matching, the inner spring units 65 as well as the mattress cover sets 53 may be provided with sensor readable coded labels or may be coordinated with electronic files by controller 100. The resulting products 70 may then include mattresses having covers and inner springs specified by product description parameters in data files processed by computer 100. Examples of such files are described in U.S. patent application Ser. No. 09/301,653, filed Apr. 28, 1999, now U.S. Pat. No. 6,105,520 hereby expressly incorporated by reference herein.

The above description is representative of certain preferred embodiments of the invention. For example, while described in the context of a mattress manufacturing, the certain aspects of the method of arranging the printing of different patterns on mattress covers can be used for other applications where fabrics are printed, such as in the production of upholstery, bedspreads and comforters, and other textile and patterned fabric production. Those skilled in the art will further appreciate that various changes and additions may be made to the embodiments described above without departing from the principles of the present invention.

Therefore, the following is claimed:

1. A quilting method comprising:

feeding fabric in web form through a printing station having a computer controllable printer thereat;

communicating data of a plurality of different patterns to the printer at the printing station;

at the printing station, scanning a web of the fabric with a print head of the printer and printing with the print head a plurality of panels on the web each with one of the patterns in accordance with the communicated data;

moving the web of fabric having the plurality of panels respectively printed thereon with the patterns from the printing station to a quilting station;

combining the web of fabric having the plurality of panels respectively printed with the patterns with at least one layer of fill material; and at the quilting station, quilting the plurality of panels of the web with at least one layer of fill material at the quilting station.

2. The method of claim 1 wherein:

the quilting station and the printing station are assembled along the same production line.

3. The method of claim 1 wherein:

the quilting station is located on a quilting line;

the printing station is located on a printing line that is separate from the quilting line; and the moving of the web of fabric includes transferring the web having the plurality of panels respectively printed thereon with the patterns from the printing line to the quilting line.

4. The method of claim 1 wherein the fabric is ticking material and the method further comprises the step of:

scheduling said printing by grouping border panels of different mattress covers for printing on a section of a web of the ticking material and grouping top and bottom panels of said different mattress covers for printing on a different section of the same or a different web of the ticking material;

the feeding of the ticking material includes separately feeding the web sections of the ticking material through a printing station; and the printing onto the web includes printing onto one web section a plurality of border panels, each with one of the plurality of the different patterns in accordance with the communicated data and separately printing onto a different web section a plurality of top or bottom panels with patterns respectively corresponding to each of the patterns printed onto the border panels.

5. The method of claim 4 wherein:

the web sections are different longitudinal sections of the same contiguous web of ticking material;

the feeding of the ticking material includes sequentially feeding the web sections of the ticking material through a printing station of a print line;

the printing onto the web includes printing first onto one web section and then onto the other web section at a printing station on the same print line.

6. The method of claim 5 further comprising:

severing the web section having border panels printed thereon from the web section having the top or bottom panels printed thereon; and the moving of the web of ticking material includes separately transferring severed web sections of ticking material to different quilting lines at which the combining of the quilting of border panels and the quilting of top and bottom panels are respectively carried out.

7. The method of claim 4 further comprising:

cutting each of the panels from other panels of the same web sections; and matching a cut border panel with corresponding cut top and bottom panels to form a matching set of panels of a mattress cover.

8. The method of claim 7 further comprising:

combining each mattress cover with a mattress interior to form a mattress product.

9. The method of claim 8 wherein:

the printing of patterns includes the printing of product identifying information on the ticking material identifying a product to which each panel corresponds;

the cutting includes cutting the panels from the other panels of the web sections along with their corresponding product identifying information; and the matching of the panels and the combining of the mattress covers with the mattress interiors is carried out in response to a comparison of the product identifying information printed with the panels and associated with the mattress interiors.

10. The method of claim 7 wherein:

the printing includes printing product identifying information on the ticking material identifying the product to which each panel corresponds;

the cutting includes cutting the panels from the other panels of the web sections along with their corresponding product identifying information; and the matching of the panels is in response to a comparison of the product identifying information printed with the panels.

11. The method of claim 10 wherein:

the product identifying information is manually readable.

12. The method of claim 10 wherein:

the product identifying information is machine readable code; and the matching includes automatically reading the code and matching the panels in response to the reading of the code.

13. The method of claim 7 further comprising:

generating electronic records for coordinating the printing, quilting and matching of the panels; and controlling the printing, quilting and matching of the panels in response to the generated records.

14. The method of claim 4 further comprising:

generating electronic records for coordinating the printing and quilting of the panels; and controlling the printing and quilting of the panels in response to the generated records.

15. The method of claim 4 wherein:

the grouping of border panels of different mattress covers for printing includes arranging border panels side-by-side on transversely spaced areas of a web section.

16. The method of claim 15 wherein:

the printing of the plurality of border panels includes printing different ones of the plurality of the different patterns on different ones of the transversely spaced areas of the web section.

17. The method of claim 4 wherein:

the grouping of the border panels of different mattress covers for printing includes arranging the border panels side-by-side on transversely spaced areas of the web section; and the method further comprises slitting the web section to separate the border panels on the transversely spaced areas one from another.

18. The method of claim 1 wherein:

the scanning and printing include printing different ones of the plurality of the different patterns side-by-side on different transversely spaced areas of the fabric; and the method further comprises longitudinally slitting the fabric to separate the transversely spaced areas one from another.

19. The method of claim 18 wherein:

the scanning and printing include printing longitudinal lines between adjacent different transversely spaced areas of the fabric; and the longitudinal slitting of the fabric is carried out in reference to the printed lines.

20. The method of claim 18 wherein:

the longitudinal slitting includes automatically registering a slitting element with printing applied to the fabric at the printing station and slitting the fabric with the registered slitting element.

21. The method of claim 20 wherein:

the longitudinal slitting includes automatically aligning the web with the slitting element.

22. The method of claim 1 further comprising:

cutting each of the panels from the other panels of the respective web sections; and matching a cut panel to a bedding product.

23. The method of claim 22 further comprising:

the printing includes printing product identifying information on the fabric identifying the product to which each panel corresponds;

the cutting includes cutting the panels from the other panels of the web sections along with their corresponding product identifying information; and the matching of the panels to the bedding product is in response to the product identifying information printed with the panels.

24. The method of claim 23 wherein:

the product identifying information is manually readable and the matching is carried out by a manual reading of the printed product identifying information.

25. The method of claim 23 wherein:

the product identifying information is machine readable code; and the matching includes automatically reading the code and matching the panels in response to the reading of the code.

26. The method of claim 22 further comprising:

generating electronic records for coordinating the printing, quilting and matching of the panels; and controlling the printing, quilting and matching of the panels in response to the generated records.

27. The method of claim 1 wherein:

the printing includes printing a product label on the panel along with the pattern.

28. A quilting apparatus comprising:

a printing station having a computer controllable printer thereat;

a computer programmed to communicate data of a plurality of different patterns to the printer at the printing station;

the printer includes a print head operable to scan a web of the fabric at the printing station and printing a plurality of panels across the web each with one of the patterns in response to the communicated data; and a quilting station operable to combine and quilt together the web of fabric having the plurality of panels respectively printed with at least one layer of fill material.

29. The apparatus of claim 28 comprising a single quilt manufacturing line that includes the computer, the printing station and the quilting station.

30. The apparatus of claim 28 comprising two independently controllable production lines including a print line that includes the printing station and the computer and a quilt line that includes the quilting station.

* * * * *